US006530098B1

(12) United States Patent
Gringer et al.

(10) Patent No.: US 6,530,098 B1
(45) Date of Patent: Mar. 11, 2003

(54) MULTIPLE TOOL DEVICE

(75) Inventors: Donald Gringer, New York, NY (US); Yuan Fang Cheng, Forest Hills, NY (US)

(73) Assignee: Allway Tools, Inc., Bronx, NY (US)

( * ) Notice: Subject to any disclaimer, the term of this patent is extended or adjusted under 35 U.S.C. 154(b) by 0 days.

(21) Appl. No.: 09/928,794

(22) Filed: Aug. 13, 2001

Related U.S. Application Data

(60) Provisional application No. 60/224,624, filed on Aug. 11, 2000.

(51) Int. Cl.[7] ..... B44C 7/08

(52) U.S. Cl. ..... 7/105; 7/165

(58) Field of Search ..... 7/105, 143, 165; 81/177.1, 489; 30/169, 340, 342

(56) References Cited

U.S. PATENT DOCUMENTS 845,340 A * 2/1907 Drew ..... 279/104
1,043,699 A * 11/1912 Hoppe ..... 132/76.5
1,332,256 A * 3/1920 Hart ..... 294/57
1,978,532 A * 10/1934 Gurnee ..... 279/93
3,184,270 A * 5/1965 Ruhala ..... 16/441
3,683,984 A * 8/1972 Hull ..... 81/177.4
5,063,627 A * 11/1991 Marra ..... 30/169
D326,546 S 5/1992 Gringer et al.
D327,553 S 6/1992 Gringer et al.
5,186,507 A * 2/1993 Neidfeld ..... 294/3.5
5,250,026 A * 10/1993 Erlich et al. ..... 604/60
5,251,352 A * 10/1993 Cullison ..... 7/105
5,265,504 A * 11/1993 Fruhm ..... 81/177.4
5,592,862 A * 1/1997 Macor ..... 81/177.4
5,638,727 A 6/1997 Gringer et al.
5,918,513 A * 7/1999 Ho ..... 81/177.4
5,956,799 A * 9/1999 Panaccione et al. ..... 15/236.01
6,006,384 A * 12/1999 Toal ..... 7/105
RE36,797 E * 8/2000 Eggert et al. ..... 81/438
6,131,222 A * 10/2000 Anderson et al. ..... 7/105
6,134,743 A * 10/2000 Schmidt ..... 15/236.01
6,182,317 B1 * 2/2001 Huang ..... 7/105
6,272,708 B1 * 8/2001 Chen ..... 7/105
2001/0032531 A1 * 10/2001 Kozak et al. ..... 81/490

* cited by examiner

*Primary Examiner*—Joseph J. Hail, III
*Assistant Examiner*—David B. Thomas
(74) *Attorney, Agent, or Firm*—Gottlieb, Rackman & Reisman, P.C.

(57) ABSTRACT

A taping knife includes a continuous shaft having a blade on a first end thereof, and a hammer on a second end thereof. A handle surrounds the shaft with the blade extending from one end thereof, and the hammer extending from the other end thereof. The handle preferably is constructed with a molded inner core and a soft molded rubber overlay. The hammer includes a hammering surface generally perpendicular to a central axis of the handle. The inner core is preferably constructed of a molded thermoplastic, and the overlay is preferably constructed of an injection molded rubber. The handle may include a bit storage slot for receiving and storing a screwdriver bit. The overlay may include a plurality of flexible fingers adjacent to the bit storage slot for securing a screwdriver bit in the slot. The hammer may include a sleeve for receiving a screwdriver bit with a working portion of the bit extending from the sleeve.

12 Claims, 11 Drawing Sheets

MULTIPLE TOOL DEVICE

The application claims priority, based on U.S. Provisional Application Serial No. 60/224,624, filed Aug. 11, 2000.

BACKGROUND OF THE INVENTION

1. Field of the Invention

The present invention relates generally to a multiple tool device, and more particularly to a multiple tool device having a taping knife, hammer and/or screwdriver in combination.

2. Description of the Related Art

Taping knives and scrapers are well known in the art, and typically include a blade, which is used to spread joint compound and to apply tape, and a handle. Recent improvements in taping knives and scrapers include the addition of ergonomic handles, such as shown in Panaccione et al., U.S. Pat. No. 5,956,799. This patent discloses a low friction handle to enable easy insertion and removal from a user's pocket.

Other taping knives have included a solid bumper or hammer at the handle end of the tool. Such taping knives are used as a hammer when, during application of joint compound, a user encounters a raised nail that prevents a smooth finish. When this occurs, the user reverses the taping knife and hits the raised nail with the bumper end to sink the nail further into the wall. This allows the user to complete the joint compound application without having to use a hammer.

Typically, conventional taping knife/hammer combinations include a molded handle with a blade on one end and a press-fit bumper inserted into the opposite end. This type of tool tends to fail under the continued stress of applying both joint compound and hammering force on nails.

Another drawback of conventional taping knife/hammer combinations is that in modern construction, drywall screws are generally used for fastening drywall. A raised drywall screw typically cannot be sunk with normal downward force on a hammer. In this case, it is necessary for the drywall installer to use a separate screwdriver to sink the screw below the surface of the drywall.

Accordingly, it would be desirable to have a taping knife that overcomes the shortcomings of prior taping knives.

SUMMARY OF THE INVENTION

The present invention is a taping knife comprising a continuous shaft having a blade on a first end thereof, and a hammer on a second end thereof. A handle surrounds the shaft with the blade extending from one end thereof, and the hammer extending from the other end thereof. The handle preferably is constructed with a molded inner core and a soft molded rubber overlay. The hammer includes a hammering surface generally perpendicular to a central axis of the handle. The inner core is preferably constructed of a molded thermoplastic, and the overlay is preferably constructed of an injection molded rubber.

If desired, the handle may include a bit storage slot for receiving and storing a screwdriver bit. The bit storage slot may also include a magnet for securing a screwdriver bit in the slot. The overlay may include a plurality of flexible fingers adjacent to the bit storage slot for securing a screwdriver bit in the slot.

In one embodiment, the hammer includes a sleeve for receiving a screwdriver bit with a working portion of the bit extending from the sleeve. The sleeve may include a magnet at a base thereof for securing the screwdriver bit in the sleeve.

An alternative taping knife comprises a handle, a blade mounted within the handle, and a screwdriver or screwdriver receiving slot mounted to the handle. The screwdriver is preferably affixed to the handle at a distal end thereof parallel to a central axis of the taping knife. In one embodiment, the blade includes a tang end having a plurality of teeth, and the handle includes a cavity for receiving the tang end of the scraper. The teeth of the blade engage walls of the cavity for permanently mounting the scraper in the handle. If desired, a hammer face may be mounted to the handle, with the screwdriver receiving slot disposed in the hammer face. The blade and the screwdriver may be of continuous construction, if desired.

A further alternative taping knife includes a handle, a scraper having a blade end and a tang end, the tang end of the scraper being mounted in the handle, and a hammer mounted in the handle in contact with the scraper. A screwdriver or screwdriver mounting may also be mounted to the handle. In one embodiment, the hammer includes the screwdriver mounting.

A still further alternative taping knife includes a handle and a bit storage slot mounted in the handle for storing a screwdriver bit.

Another still further alternative taping knife includes a handle, and a hammer end mounted in the handle, the hammer end comprising a hammering face and a slot for receiving a screwdriver bit.

A method of manufacturing a taping knife comprises the steps of:

- placing a hammer end in a first mold, the first mold being in the shape of a handle, the first mold structured and arranged to create a cavity open at a front end of the handle, the hammer end comprising at least one retaining cavity formed to receive plastic injected in the first mold;
- injecting plastic into the first mold to form an inner core of the handle, the hammer end being exposed at the end of the cavity;
- placing the inner core into an overlay mold and injecting a moldable rubber into the overlay mold to overlay portions of the inner core; and
- inserting a scraper into the cavity with a tang end thereof abutting the hammer.

DETAILED DESCRIPTION OF THE INVENTION

Figure 1:
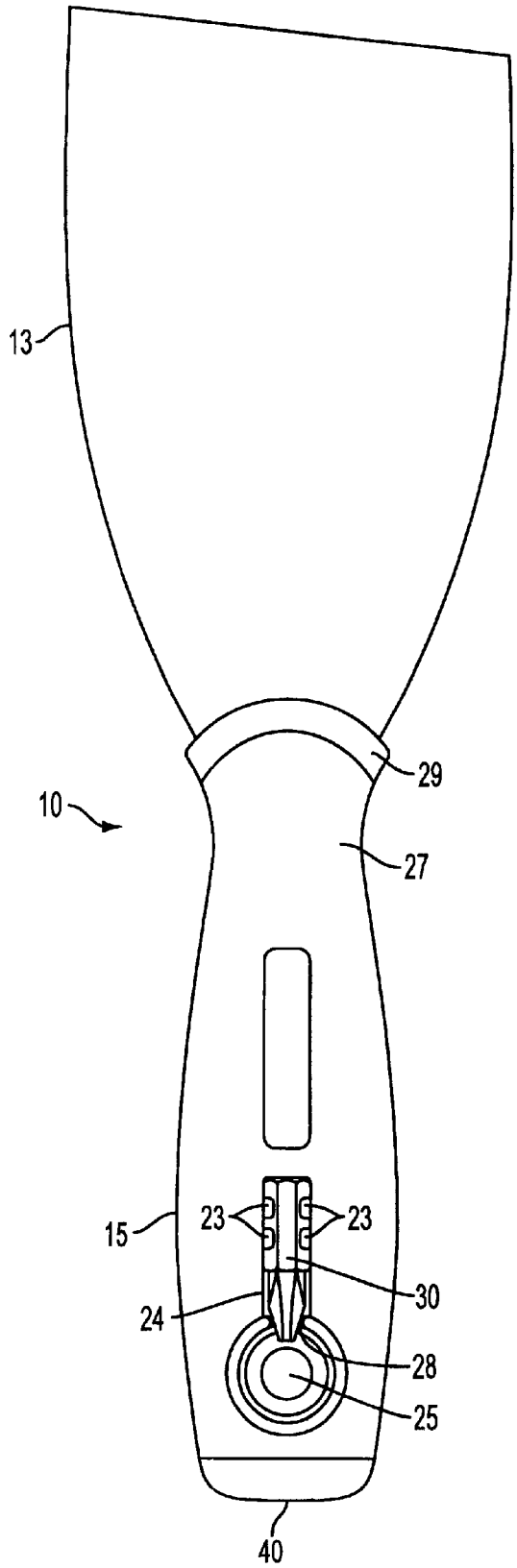
FIG. 1 is a side view of the multiple tool device according to the present invention.

The present invention is a combination taping knife, hammer and/or screwdriver. Referring to FIGS. 1–6, taping knife 10 includes a handle 15 constructed of an inner core 29 partially covered by an overlay 27. Inner core 29 is preferably integrally molded of a thermoplastic, and overlay 27 is preferably constructed of an injection molded rubber such as SANTOPRENE®. A bit storage slot 24 is formed in the surface of overlay 27 and/or inner core 29 to hold a screwdriver bit 30. Bit 30 is preferably a conventional hexagonal.driving bit of the type well known in the art, although it is foreseen that any appropriate driving bit may be used. On the lower surface of bit storage slot 24, embedded in inner core 29, is a magnet 35 used to retain bit 30 in the bit storage slot. Flexible fingers 23, which are preferably constructed of the same material as overly 27, extend over slot 24 to help prevent bit 30 from falling from the bit storage slot. In use, screwdriver bit 30 is frictionally fit into slot 24, and is retained in the slot by the combined retaining forces of fingers 23 and magnet 35.

A bumper or hammer end 40 is attached to a first end of handle 15, and a scraper 13 is attached to an opposite end thereof. As shown in FIGS. 2–5, hammer end 40 is embedded in inner core 29, with hammer head 43 exposed to be used for hammering purposes. An optional hook aperture 25 extending through end cap 40 enables the user to hang tool 10 during storage. The outer rim 28 of hook aperture 25 may be sized to contact the front face of bit 30 to prevent longitudinal movement of bit 30 in slot 24. Hammer head 43 of end cap 40 includes hexagonal slot 45 for receiving screwdriver bit 30 to enable the tool to be used as a screwdriver. A magnet 37 is provided at the base of slot 45 to magnetically retain bit 30 in slot 45 during use. Of course, sleeve 45 may have any desired shape, depending on the shape of bit 30.

Figure 2:
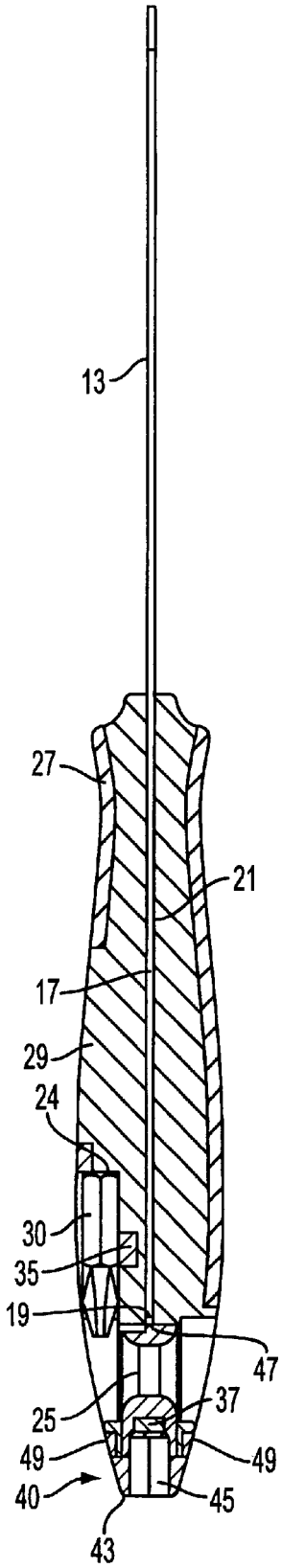
FIG. 2 is a side cross-section view of the multiple tool device shown in FIG. 1.
Figure 3:
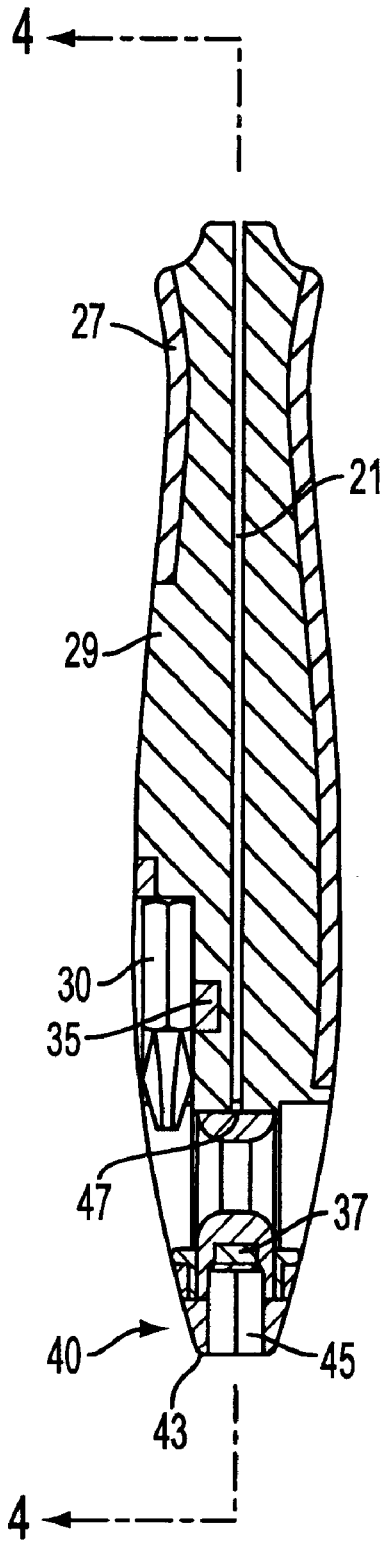
FIG. 3 is a side cross-section view of the multiple tool device shown in FIG. 1 without the blade inserted in the handle.
Figure 4:
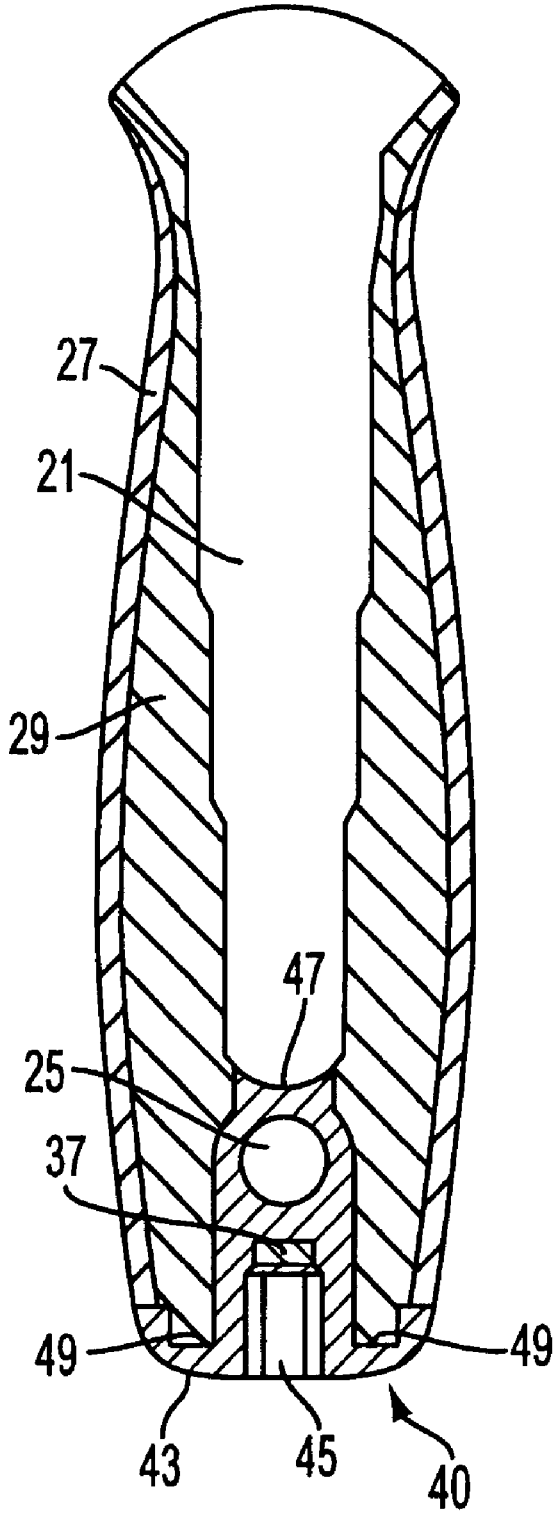
FIG. 4 is a cross-section view of the multiple tool device of the present invention through Section 4—4 of FIG. 3.
Figure 5:
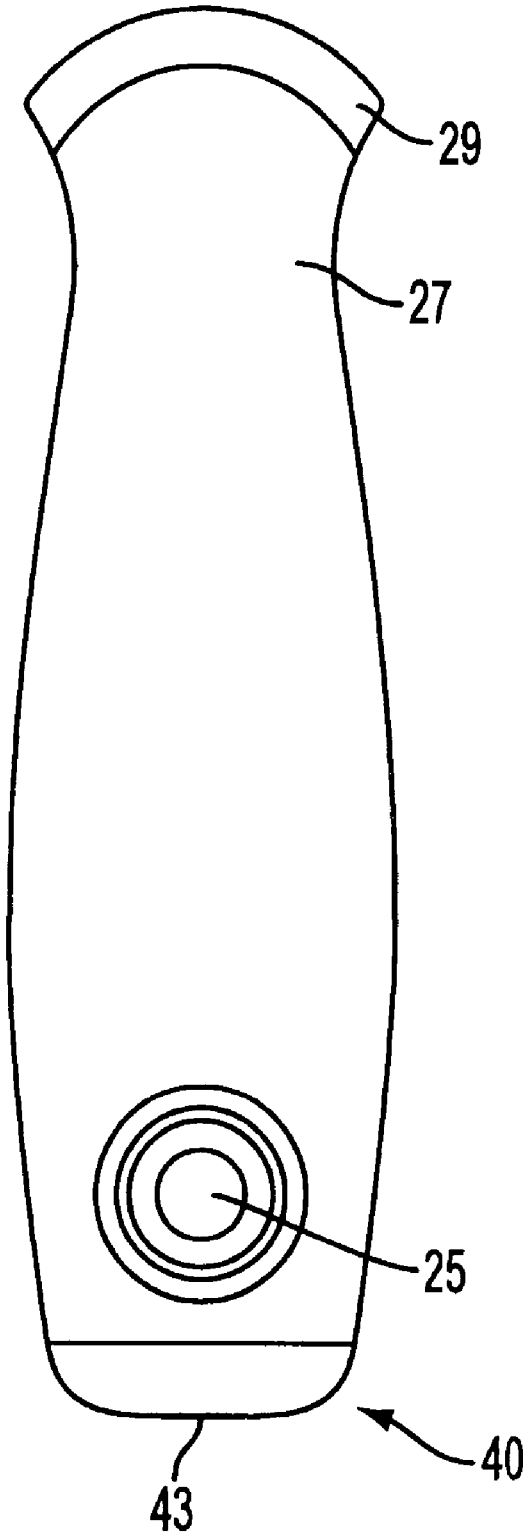
FIG. 5 is a side view of the handle of the multiple tool device of the present invention.
Figure 6:
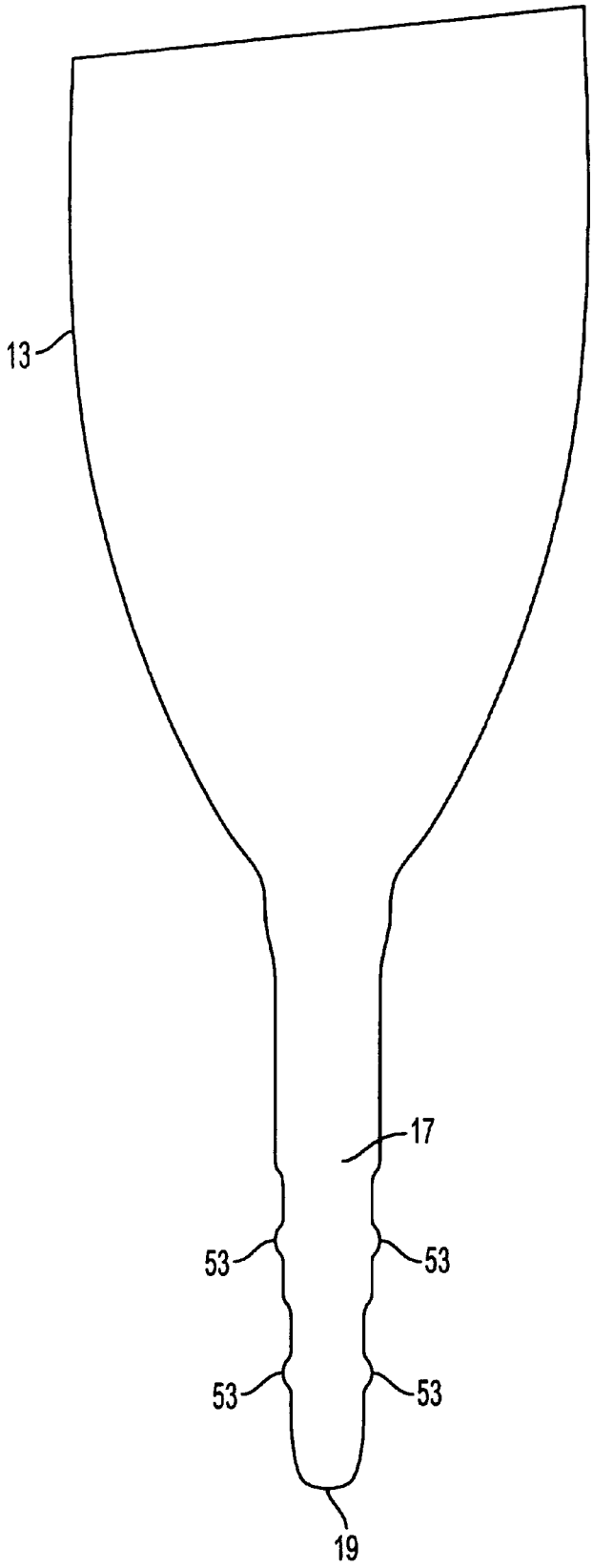
FIG. 6 is a side view of the scraper or blade of the multiple tool device of the present invention.

As shown in FIG. 2, inner core 29 preferably forms substantially the entire structure of handle 15. Overlay 27 is preferably a veneer covering most of the outer surface of inner core 29 to provide an improved gripping surface. A cavity 21 on the interior of inner core 29 receives an end 47 of hammer end 40. Cavity 21 becomes increasingly narrow from the front end of handle 15 toward bumper end 47. Scraper 13 includes a scraper end or tong end 17 that is preferably slightly wider than that of cavity 21. This provides a friction fit when scraper 13 is inserted into cavity 21. Scraper end 17 also preferably includes a plurality of teeth 53 which, when forcibly inserted into cavity 21, become embedded in the walls of cavity 21 to firmly attach scraper 13 therein. When end 17 of scraper 13 is completely inserted into cavity 21, distal end 19 thereof preferably abuts bumper end 47. This contact transfers momentum from swinging movement of the tool to the hammer end. Hammer end 40 is preferably constructed of a die cast metal and scraper 13 is preferably constructed of tempered steel. The combination of metal components through the interior of the tool provides a stiff, continuous backbone for tool 10 increasing its overall strength and durability. Moreover, the continuous metallic backbone tends to distribute the normal forces transmitted to the hammer head 43 throughout the tool, as opposed to merely at the lead edge. This increases the durability of tool 10.

Figure 7A:
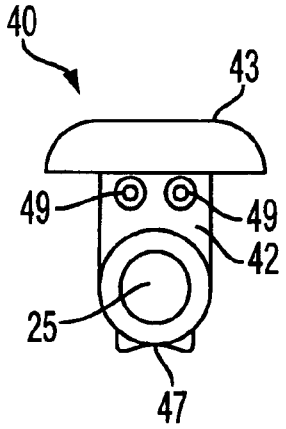
FIG. 7A is a detailed view of the bumper or hammer end of the multiple tool device of the present invention.
Figure 7B:
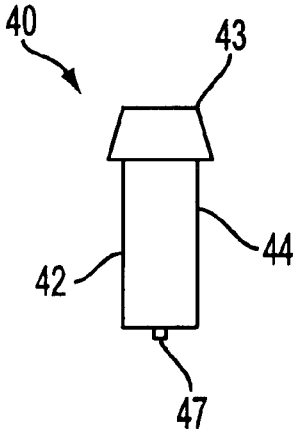
FIG. 7B is a side view of the bumper shown in FIG. 7A.
Figure 7C:
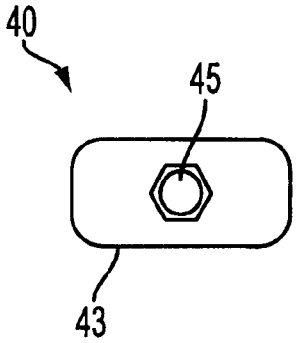
FIG. 7C is an end view of the bumper shown in FIG. 7A.

Hammer end 40, as shown more clearly in FIGS. 7A–7C, is provided with a plurality of retaining cavities 49 arranged to receive the injected molded inner core before it is cured. Cavities 49 are formed deep enough o that when the injected molded inner core cures, end cap 40 will be permanently locked in position and substantially secured in molded inner core 29. Upper and lower surfaces 42 and 44 define and border hook aperture 25. Each of the upper and lower surfaces 42 and 44 preferably includes retaining cavities 49. The portions of the injected molded inner core 29 that fill cavities 49 are preferably substantially perpendicular to the axis of the tool 10. Any forces transmitted through the handle by means of hammer action will create shear forces on the portions of the molded inner core 29 filling cavities 49. As such, cavities 49 should be formed deep enough and wide enough to sustain such shear forces and to retain end cap 40 permanently locked therein. Hammer head 43 includes a flat surface substantially perpendicular to the longitudinal axis of tool 10. Slot 45 is preferably disposed substantially in the center of hammer head 43 for receiving screwdriver bit 30 therein.

Figure 8A:
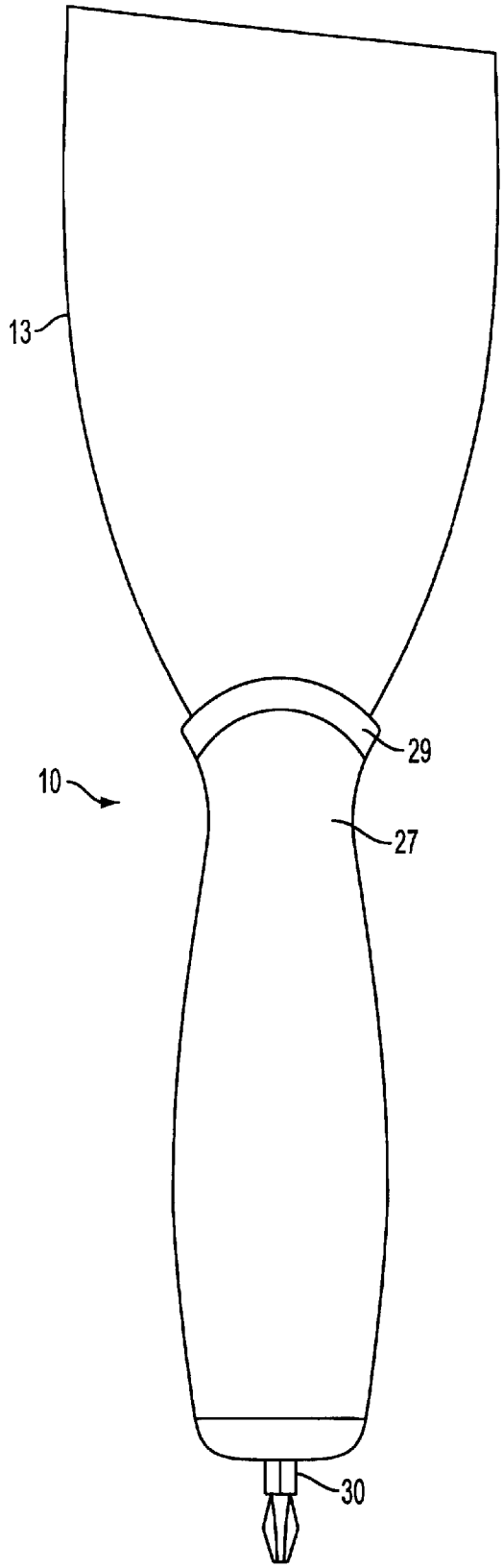
FIG. 8A shows an alternate embodiment of the multiple tool device of the present invention.
Figure 8B:
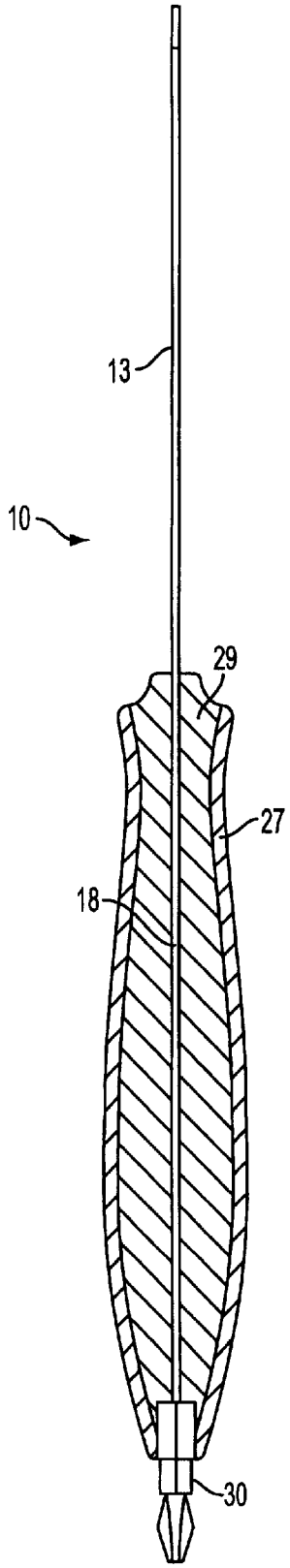
FIG. 8B is a cross-section view of the embodiment of the invention shown in FIG. 8A.
Figure 8C:
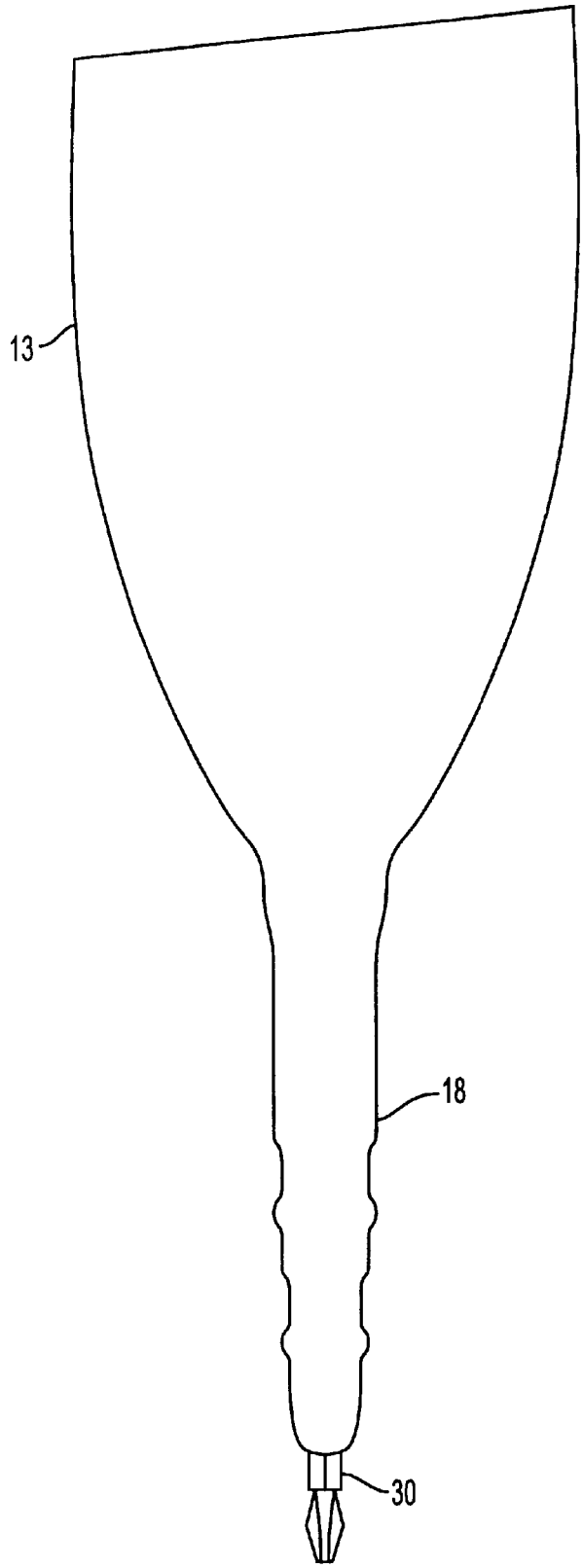
FIG. 8C is the alternate embodiment of the invention shown in FIG. 8A, with the handle removed.

FIGS. 8A–8C show an alternative embodiment of the invention in which screwdriver 30 is integrally molded with, or otherwise affixed to, scraper 13 at the distal end thereof. FIG. 8C shows an exposed view of scraper 13, with screwdriver bit 30 attached thereto via shaft 18. In this embodiment, scraper 13 and bit 30 are molded within molded core 29.

Figure 9:
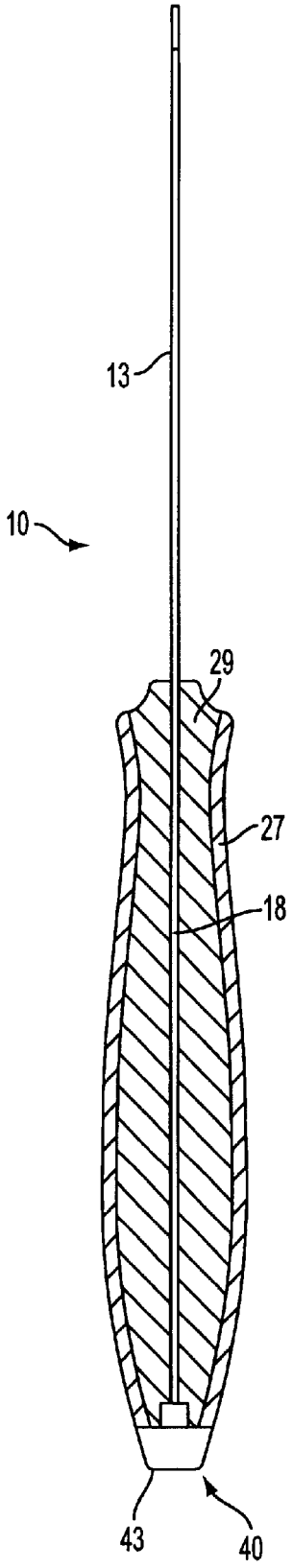
FIG. 9 shows a further alternative embodiment of the invention in cross-section.

FIG. 9 shows a further alternative embodiment of tool 10 with shaft 18 integrally constructed with, or fixedly attached to, scraper 13 and hammer end 40. The flat surface of hammer head 43 is preferably substantially perpendicular to the longitudinal axis of tool 10.

The present invention also includes a method of manufacturing a taping knife 10 having a hard molded inner core 29 covered by a soft overlay of injection molded rubber 27. Inner core 29 is first molded in the shape of a handle 15 where the mold is structured to create a cavity 21 open at a front end of the handle 15 running from the front end substantially completely through inner core 29. Cavity 21 in inner core 29 narrows from the front of the handle to the rear of the handle. Also formed in inner core 29 mold is a bit storage slot 24 for receiving and storing screwdriver bit 30.

Hammer end 40 is placed at the rear end of the mold of inner core 29, and preferably includes upper and lower surfaces 42 and 44 have a plurality of retaining cavities 49 formed to receive injection molded plastic during molding of inner core 29. Retaining cavities 49 are sufficiently deep and wide such that when molded inner core 29 cures, end cap 40 is fixeedly attached thereto.

A moldable thermoplastic, preferably polypropylene, is injected into the first mold to form an inner core 29 with cavity 21 open at the front end of the handle for receiving scraper 13. Inner core 29 is then cured to lock end cap 40 therein.

A second mold is formed for overlay 27, and cured inner core 29 is placed in the second mold. A moldable rubber is then injected into the second mold, enveloping inner core 29 at the desired gripping areas. The moldable rubber is then cured. Scraper 13 is then press fit into cavity 21. As described above, scraper 13 includes an end portion 17 with a width larger than the width of the cavity 21, and a plurality of teeth 53. When scraper end 17 is press fit into cavity 21, teeth 53 of scraper end 17 frictionally engage the walls of the cavity 21 and permanently secure scraper end 17 in a position abutting bumper end 47.

Although the present invention has been described in detail with respect to certain embodiments and examples, variations and modifications exist that are within the scope of the present invention as defined in the following claims.

What is claimed is as follows:

1. A taping knife comprising:

a continuous shaft comprising a blade on a first end thereof, and a hammer on a second end thereof; and a handle surrounding the shaft with the blade extending from a first end thereof, and the hammer extending from a second end thereof, wherein the handle comprises a molded inner core and a soft molded overlay;

wherein the handle comprises a bit storage slot for receiving and storing a screwdriver bit; and wherein the overlay comprises a plurality of flexible fingers adjacent to the bit storage slot for securing a screwdriver bit in the slot.

2. The taping knife according to claim 1, wherein the bit storage slot comprises a magnet for securing a screwdriver bit in the bit storage slot.

3. The taping knife according to claim 2, wherein the hammer comprises a hammering surface generally perpendicular to a central axis of the handle.

4. The taping knife of claim 1, wherein the hammer further comprises a sleeve for receiving a screwdriver bit with a working portion of the bit extending from the sleeve; and wherein the sleeve comprises a magnet at a base thereof for securing the screwdriver bit in the sleeve.

5. The taping knife according to claim 1, wherein the inner core is constructed of a molded thermoplastic.

6. The taping knife according to claim 5, wherein the overlay is constructed of an injection molded rubber.

7. The taping knife according to claim 4, wherein the sleeve is parallel to a central axis of the taping knife.

8. The taping knife according to claim 4, wherein the molded inner core comprises a hard plastic.

9. The taping knife according to claim 8, wherein the overlay is a rubber material.

10. The taping knife according to claim 1, further comprising a screwdriver or screwdriver mounting mounted to the handle.

11. The taping knife according to claim 10, wherein the hammer comprises the screwdriver mounting.

12. A method for manufacturing a taping knife, the method comprising the steps of:

placing a hammer end in a first mold, the first mold being in the shape of a handle, the first mold structured and arranged to create a cavity open at a front end of the handle, the hammer end comprising at least one retaining cavity formed to receive plastic injected in the first mold;

injecting plastic into the first mold to form an inner core of the handle, the hammer end being exposed at the end of the cavity;

placing the inner core into an overlay mold and injecting a moldable rubber into the overlay mold to overlay portions of the inner core; and inserting a scraper into the cavity with a tang end thereof abutting the hammer.

* * * * *